United States Patent [19]

Spac et al.

[11] 4,263,849

[45] Apr. 28, 1981

[54] STRETCHING AND FASTENING DEVICE FOR BLANKETS AND THE LIKE ON PRINTING PRESS CYLINDERS

[75] Inventors: Ivan Spac; Fred Kunkel, both of Offenbach am Main, Fed. Rep. of Germany

[73] Assignee: M.A.N.-Roland Druckmaschinen Aktiengesellschaft, Fed. Rep. of Germany

[21] Appl. No.: 100,485

[22] Filed: Dec. 5, 1979

[30] Foreign Application Priority Data

Dec. 14, 1978 [DE] Fed. Rep. of Germany ..... 7837025

[51] Int. Cl.[3] ..... B41F 27/06; B41F 29/04; B41F 7/22

[52] U.S. Cl. ..... 101/415.1

[58] Field of Search ..... 101/415.1, 378, 125, 101/126, 131, 132, 132.5, 133, 131.5, 407, 418; 51/368, 364, 367, 369, 370; 346/138; 358/291; 29/118

[56] References Cited

U.S. PATENT DOCUMENTS

| | | | |
|---|---|---|---|
| 1,257,538 | 2/1918 | Scott et al. | 101/415.1 |
| 2,937,593 | 5/1960 | Ritlerfeld et al. | 101/415.1 |
| 3,489,085 | 1/1970 | Kirkpatrick | 101/415.1 |
| 3,893,394 | 7/1975 | Fusco et al. | 101/415.1 |
| 4,092,923 | 6/1978 | Bollmer | 101/415.1 |

FOREIGN PATENT DOCUMENTS

| | | | |
|---|---|---|---|
| 393868 | 12/1921 | Fed. Rep. of Germany | 101/415.1 |
| 2252949 | 7/1977 | Fed. Rep. of Germany | 101/415.1 |

*Primary Examiner*—J. Reed Fisher

*Attorney, Agent, or Firm*—Leydig, Voit, Osann, Mayer & Holt, Ltd.

[57] ABSTRACT

A lock-up mechanism for a blanket cylinder in a printing press, the blanket having at each end a straight reinforcing bar formed of metal stock bent into "U" cross section. An arm recessed in the cylinder provides a U-shaped receptacle for receiving the reinforcing bar; the receptacle has first and second supporting surfaces offset from one another for engaging the opposite faces of the bar. A hook is provided on the arm adjacent the second supporting surface for hooking the near edge of the bar, the projection of the hook beyond such supporting surface approximating the thickness of the bar material. The U-shaped receptacle is of such a size as to permit insertion of the bar in a temporarily angled position to clear the hook. The plane of support of the bar in the receptacle is so related to the plane of application of blanket tension that when the blanket is drawn taut, torque is applied to the bar tending to seat it securely on the supporting surfaces thereby insuring that the bar is engaged and held captive by the hook until the tension is intentionally released. In the preferred form of the invention the arm is pivoted to the cylinder for swinging movement and a manually operated screw is provided for holding the arm in a rocked position thereby to adjustably tension the blanket.

2 Claims, 5 Drawing Figures

Fig. 1.
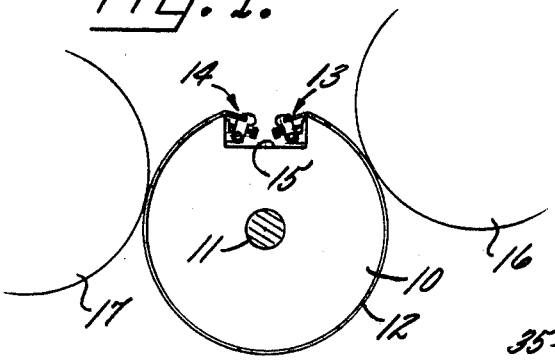
Fig. 2.
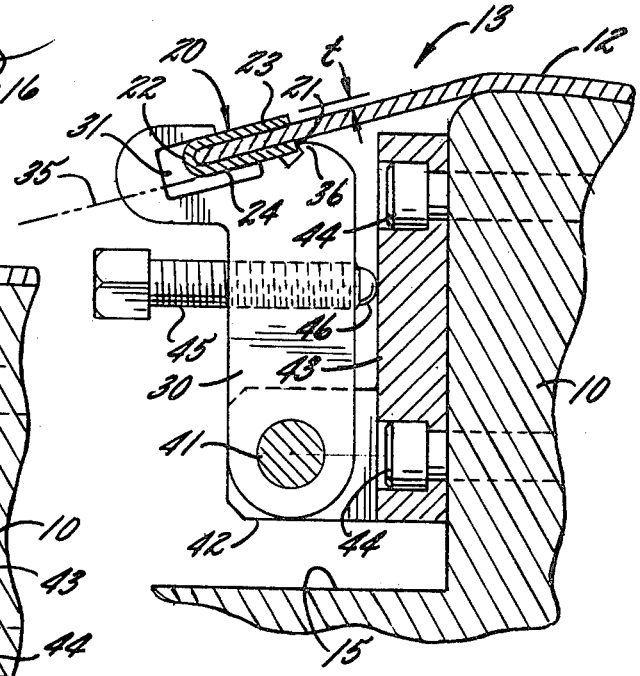
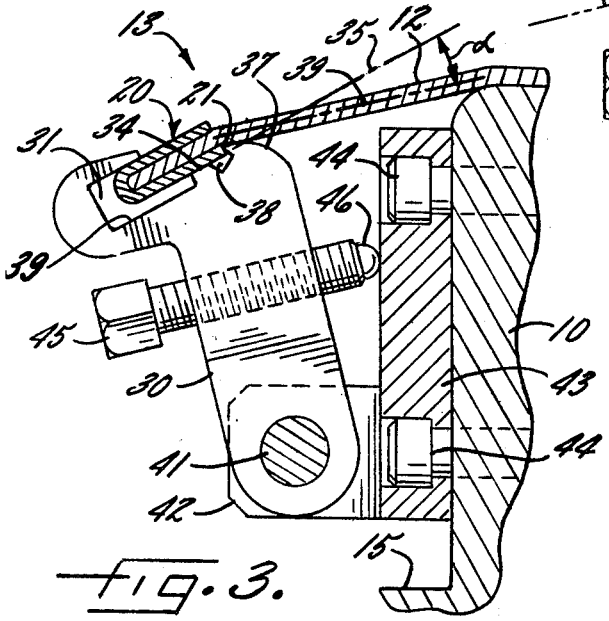
Fig. 3.
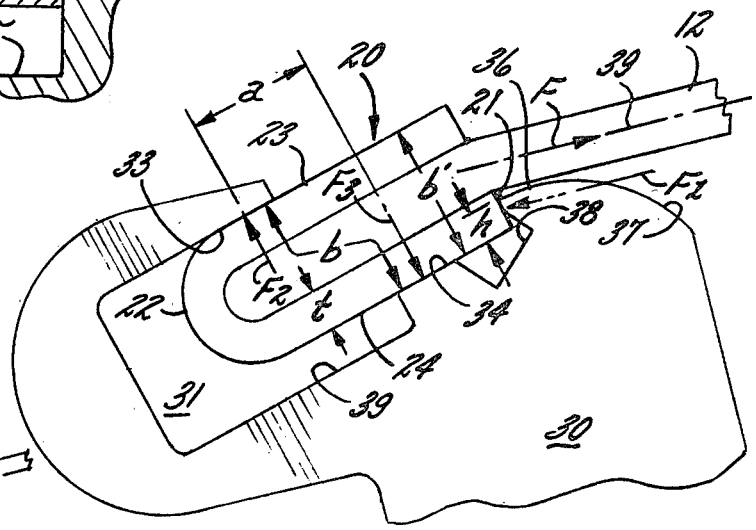
Fig. 4.
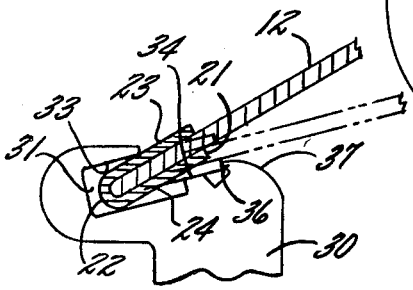
Fig. 5.

STRETCHING AND FASTENING DEVICE FOR BLANKETS AND THE LIKE ON PRINTING PRESS CYLINDERS

It is known to retain a blanket on a cylinder of a printing press by hooking a reinforcing bar at the end of the blanket in a movable receptacle. This is shown in German Auslegeschrift No. 22 52 949 which was published July 14, 1977. However, prior devices have been elaborate in construction, expensive to manufacture and difficult to use. As disclosed in the German document, for example, the reinforcing bar at the end of the blanket, instead of being a simple strip of metal bent into U shape, is of special construction which must be expensively milled to a predetermined contour from a solid steel bar. The frame which engages the reinforcing bar is also of expensive construction with several movable parts including an adjusting screw 30, having an associated plunger and biasing spring, as well as a manually operated knurled knob which must be rotated between locking and unlocking positions each time a blanket is installed or removed. Moreover, the construction is difficult to use. As shown in FIG. 3 of the document, when the blanket is inserted into the receptacle it must be pushed in hard enough to overcome the restoring force of the spring-pressed plunger 32, and the same restoring force must be overcome when the blanket is removed. Where the blanket is of rubber or limp material it may be impossible to develop enough force in the blanket, in compression, to overcome the force of the spring. The screw 30 is provided for necessary adjustment, but with the parts mounted as taught in FIG. 1 of the patent, such adjustment is completely inaccessible.

It is, accordingly, an object of the present invention to provide an improved construction which is highly economical, in which the blanket is held captive without necessity of any moving parts and without requiring any adjustment.

It is another object to provide a lock-up mechanism for a blanket which is easy and convenient to use, with the reinforcing bar at the end of the blanket being freely insertable and freely removable without necessity for overcoming any spring force and without any need for manipulating any clamping element. For entry of the bar it is simply rocked about its longitudinal axis prior to insertion; for release the bar is rocked in the opposite direction.

Notwithstanding the fact that the device is free of any movable clamping element the device is, nonetheless, completely reliable and secure. It is so constructed that the tension developed in the blanket produces a torque which keeps the reinforcing bar seated on supporting surfaces in a securely hooked captive condition; the greater the tension the more secure the captivity. Reliability and ease of hooking and unhooking are unaffected by accumulations of dirt or lint at the engaged surfaces.

It is a further and important object of the construction that the supporting bar for the blanket need not be especially constructed or especially contoured or fitted for retention. On the contrary, the lock-up is intended for use with a conventional reinforcing bar formed of a simple metal strip bent into "U" cross section with a wide range of dimensional tolerance.

Other objects and advantages of the invention will become apparent upon reading the attached detailed description and upon reference to the drawing in which:

FIG. 1 shows the general type of printing press cylinder to which the invention is applicable.

FIG. 2 is an elevational view showing a lock-up assembly constructed in accordance with the invention holding one end of the blanket captive.

FIG. 3 is a view similar to FIG. 2 but showing the blanket stretched in taut condition.

FIG. 4 is a fragmentary diagram showing the dimensional relationships and the forces at work in maintaining the blanket captive.

FIG. 5 is a diagram showing angling of the reinforcing bar for insertion and removal.

While the invention has been described in connection with a preferred embodiment, it will be understood that I do not intend to be limited to the particular embodiment shown but intend to cover the various alternative and equivalent constructions included within the spirit and scope of the appended claims.

Referring to FIG. 1 of the drawing there is shown a blanket cylinder 10 having a shaft 11 and about which is stretched a blanket 12. The ends of the blanket are respectively secured in lock-up assemblies 13, 14 recessed in a groove 15. In a typical usage of a blanket cylinder of the present type in a lithograph press, the cylinder may be interposed between a plate cylinder 16 and an impression cylinder 17. However, it will be understood that the lock-up disclosed and claimed herein is not intended for any particular kind of blanket and is of general utility in both lithograph and letter presses, wherever it is desired to hold a flexible layer upon a cylinder securely under tension. The term "blanket" is therefore used in a general sense to include any outer flexible covering for a cylinder regardless of the material of which the layer is formed.

Turning attention to the lock-up assembly 13 (FIGS. 2–5), it will be seen, first of all, that the blanket 12 has, at its end, a reinforcing bar 20. Such reinforcing bar will be recognized as being of conventional shape formed of a strip of metal having appreciable thickness "t" bent into "U" cross section to form opposed walls pressed into clamping engagement with the end of the blanket. Thus formed, the reinforcing bar has a near edge 21, a far, or bent, edge 22, a first or upper face 23 and a second or lower face 24. It is the purpose of the present invention to seat the faces 23, 24 in such a way, and in such a plane of support, as to hook the near edge 21 securely on an adjacent hook.

The reinforcing bar is engaged by an arm 30 which is recessed in the cylinder and which has a U-shaped receptacle 31 for captively receiving the bar. In accordance with the invention the receptacle has a first supporting surface 33 for engaging the first face 23 of the bar and a second supporting surface 34 for simultaneously engaging a second, or lower, face 24 of the bar. The first supporting surface 33 engages the bar adjacent the far edge 22. The second supporting surface 34 engages the second face 24 of the bar at a longitudinally offset position adjacent the near edge of the bar. Thus the bar is oriented in a "plane of support" 35.

Further in accordance with the invention a hook 36 is provided on the arm adjacent the second supporting surface 34 for hooking the near edge of the bar in its thickness dimension against edgewise withdrawal from the receptacle. The hook projects beyond the second supporting surface by an amount h (see FIG. 4) approximately equal to the thickness t of the bar stock of which the bar is formed. On the righthand side of the hook is a curved supporting surface or ramp 37, while at the left side of the hook is a hook clearance space 38.

The hook projection h is preferably somewhat less than the thickness t of the bar stock so that the hook does not dig into or otherwise damage the blanket.

In carrying out the invention, the second supporting surface 34 is in the form of a pedestal of limited area having, on its left hand side as viewed in the drawing, a bar clearance space, or pocket, 39 forming a part of the receptacle 31 and which is sufficiently deep as to permit substantial rocking movement of the bar 20 about its longitudinal axis to clear the hook as shown in FIG. 5 incident to hooking and unhooking. With the bar restored to its straight condition under conditions of lock-up, when the blanket is drawn taut, a force F is developed therein along a plane 39. Such force creates a reactive force F1 at the hook 36. However, in addition the force F, by reason of the fact that it is slightly offset from the hook, results in a torque about a longitudinal axis which creates a force couple consisting of a force F2 at the first supporting surface 33 at the top of the bar and a force F3 against the second supporting surface 34 at the bottom of the bar. Moreover, when the arm 30 is angled as shown in FIGS. 3 and 4, a direct reaction component of the force F is developed at surface 34 proportional to the angle of tilt of the arm, and such reaction component further augments the force F3. The forces F2, F3 act to keep the bar firmly seated in its plane of support resulting in secure and reliable engagement between the near edge 21 of the bar and the hook 36. The greater the tensioning force F the greater are the forces F2, F3 keeping the bar seated in its capitve, hooked position.

It is one of the features of the present invention that the arm 30 is pivoted to the cylinder for swinging movement about an axis which is spaced inwardly from the receptacle, in the direction of the cylinder axis, with manually operated means for rocking the arm and holding it in a rocked position. Thus the arm 30 is pivoted on hinge pin 41 mounted on a bracket 42. The bracket is secured to a base member or pedestal 43 which is secured to the side wall of the groove 15 by means of screws 44. For rocking the arm, an adjusting and tensioning screw 45 is threaded into it, presenting a tip 46 which bears against the pedestal 43. Thus by rotating the screw 45, the arm 30 is swung in the counterclockwise direction resulting in increasing tension in the blanket. As stated, it is one of the features of this arrangement that the greater the angle of swing of the arm and hence the greater the tension developed in the blanket, the greater becomes the angle between the plane of support 35 and the plane 39 in which the tensile force is exerted, indicated at $\alpha$ in FIG. 3; hence the forces which seat the bar in captive position increase automatically not only with the tensile force but with the angle of the arm which creates the tensile force.

Notwithstanding the secure attachment provided by the present invention, it is one of the outstanding features of the construction that the reinforcing bar at the end of the blanket may be inserted into the receptacle 31 freely and without having to overcome any spring reaction force. All that is necessary is to slightly angle the bar about its own longitudinal axis into the position shown in FIG. 5 so that it clears the hook 36, passing down into the recess beyond the normal operating position. Thus when the blanket is subsequently straightened and drawn taut, into the dot-dash position shown in FIG. 5, the near end 21 of the bar positively engages the hook 36 without necessity for manipulating any special fastening element. Subsequently developing tension in the blanket by rocking the arm 30 causes the reinforcing bar to be even more firmly seated.

Removal is equally convenient: The screw 45 is unscrewed which permits the arm 30 to swing in the clockwise direction reducing the tension in the blanket to zero and creating slack therein. This permits the end of the blanket to be angled upwardly as shown in FIG. 5 disengaging the hook 36, following which the reinforcing bar may be freely withdrawn.

By the term "appreciable thickness" as used herein, as applied to the thickness t of the stock of which the reinforcing bar is formed, it will be understood that this refers to thickness which is adequate to achieve positive overlapping engagement by a relatively sharp hook 36. Conventional reinforcing bars normally satisfy this requirement.

In designing a practical device in accordance with the principles set forth above it is desired to make the surface 34 of limited area and the distance a, which is the offset between the first and second supporting surfaces 33, 34, as great as possible while not exceeding the peripheral dimension of the bar. It is also desirable to make the perpendicular spacing b between the supporting surfaces approximately equal to, or slightly greater than, the thickness b′ of the reinforcing bar. It is one of the features of the present construction that, notwithstanding the lack of local actuating or adjusting elements, reliable retention is secured without need to adhere to close dimensional tolerances.

While only transaxial views of the device have been shown, it will be understood that there is no intention to limit the width of the arms 30 in the axial direction. Thus the arm 30 may, if desired, extend the axial length of the cylinder with an adjusting and tensioning screw 45 provided at intervals therealong, thereby to achieve continuous engagement with the reinforcing bar. Or, if desired, the arm 30 may be provided in multiple each with a screw 45 for engagement of the reinforcing bar at spaced points. Also, while swingable arms 30 have been shown, in FIG. 1, at both the leading and trailing edges of the blanket, the leading edge may if desired be fixedly engaged in the receptacle 31 as described and with only the trailing edge being subject to take-up and tensioning by the manually operated screws 45.

What we claim is:

1. A lock-up mechanism for a blanket cylinder in a printing press comprising, in combination, a blanket having at each end a straight reinforcing bar clamped thereto, the bar being formed of metal strip stock of appreciable thickness bent into "U" cross section to form opposed walls having near and far edges and presenting first and second faces on its respectively opposite sides, an arm recessed in the cylinder having a U-shaped receptacle for receiving the reinforcing bar, said receptacle providing a first supporting surface for engaging the first face of the bar adjacent the far edge thereof and a second supporting surface offset from the first supporting surface for simultaneously engaging the second face of the bar adjacent the near edge thereof to define a plane of support, a hook on the arm adjacent the second supporting surface for hooking the near edge of the bar in its thickness dimension against removal from the receptacle, the projection of the hook beyond the second supporting surface approximating the thickness of the (bar) strip stock, the second supporting surface being in the form of a pedestal of limited area defining an adjacent clearance space which is sufficiently deep as to permit substantial rocking movement of the bar about its longitudinal axis to clear the hook incident to hooking and unhooking of the bar, the plane of support being so related to the plane of application of blanket force that when the blanket is drawn taut torque is applied by the blanket about the axis of the reinforcing bar tending to seat it securely on the supporting surfaces thereby insuring that the bar is engaged and held captive by the hook.

2. The combination as claimed in claim 1 in which the arm is pivoted to the cylinder for swinging movement about an axis which is spaced inwardly of the receptacle in the direction of the cylinder axis and parallel thereto, and manually operated means for rocking the arm and holding it in a rocked position.

* * * * *